United States Patent [19]

Waulters

[11] 4,360,198

[45] Nov. 23, 1982

[54] WEIGHT LIFTING SAFETY FRAME FOR EXERCISING

[76] Inventor: Larry Waulters, Rte. 1, Hallsville, Mo. 65255

[21] Appl. No.: 232,192

[22] Filed: Feb. 6, 1981

[51] Int. Cl.[3] ..... A63B 21/06

[52] U.S. Cl. ..... 272/117; 272/DIG. 4; 272/123; 272/143

[58] Field of Search ..... 272/93, 103, 116–119, 272/122, 123, 134, 144

[56] References Cited

U.S. PATENT DOCUMENTS

| | | | |
|---|---|---|---|
| 2,470,815 | 5/1949 | Harvey . | |
| 2,617,650 | 11/1952 | Landis | 272/122 |
| 2,932,509 | 4/1960 | Zinkin . | |
| 3,003,765 | 10/1961 | Dove | 272/117 |
| 3,118,668 | 1/1964 | Callahan . | |
| 3,268,224 | 8/1966 | Freshour . | |
| 3,290,044 | 12/1966 | Krodsen et al. . | |
| 3,346,256 | 10/1967 | White . | |
| 3,384,367 | 5/1968 | Baum | 272/103 |
| 4,018,442 | 4/1977 | Galler . | |
| 4,072,309 | 2/1978 | Wilson . | |
| 4,205,838 | 6/1980 | McIntosh . | |
| 4,252,316 | 2/1981 | Price | 272/123 |
| 4,286,782 | 9/1981 | Fuhrhop | 272/123 X |

FOREIGN PATENT DOCUMENTS

| | | | |
|---|---|---|---|
| 1447999 | 6/1966 | France | 272/123 |

*Primary Examiner*—Richard C. Pinkham
*Assistant Examiner*—William R. Browne
*Attorney, Agent, or Firm*—Litman, Day and McMahon

[57] ABSTRACT

A self supporting frame for exercising comprises a pair of spaced standards each having an upper and a lower end. Each standard has a respective base attached to a lower end thereof for engaging a floor surface and supporting the frame in an upright position. Each standard also has secured thereto a lower rod respectively. The rods extend outwardly in generally opposed directions and cantilever from a respective standard lower end. The frame is weighted with a pair of plates each having an aperture therethrough for slidably receiving one of the rods, the plates thereby being supported by and connected to a lower end of the standards. A bar extends between and is attached at opposed ends thereof to upper ends of each standard, the frame thereby being liftable by a person grasping the bar.

18 Claims, 8 Drawing Figures

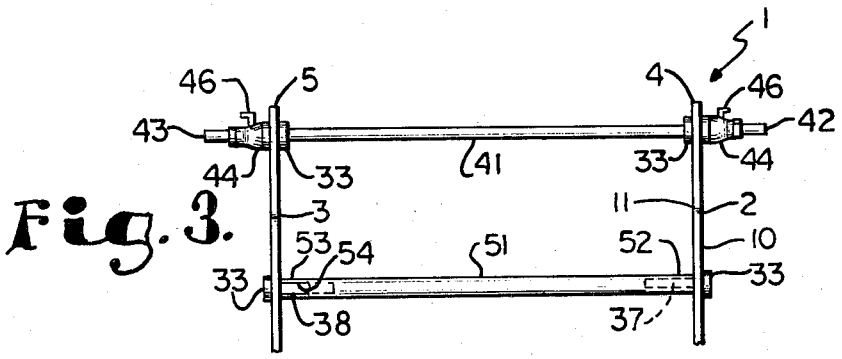
Fig. 3.
Fig. 6.
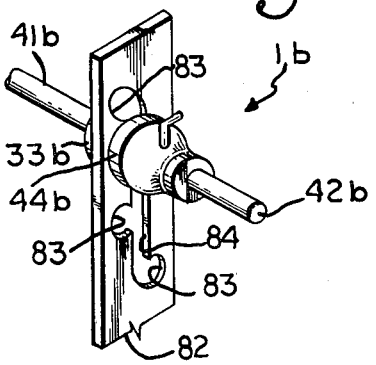
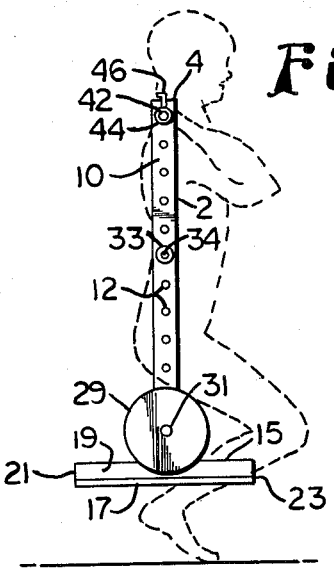
Fig. 8.
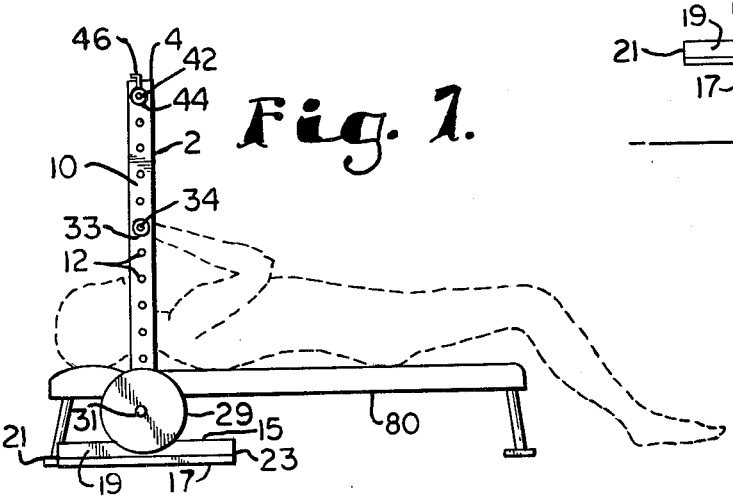
Fig. 7.

WEIGHT LIFTING SAFETY FRAME FOR EXERCISING

BACKGROUND OF THE INVENTION

This invention relates to exercising devices, and in particular to a weight lifting safety frame.

The beneficial effects of exercising with weights are well known and a variety of devices have been developed in an attempt to achieve efficient muscle development at minimal risk to the weight lifter. Such devices may be grouped into two general classes, one class characterized by "mechanical" weights wherein guide means is provided so that the movement of the weighted device being lifted is along a predetermined path. See, for example, the upright parallel rods shown in the White U.S. Pat. No. 3,346,256, which alloy only a predetermined movement of a respective weighted device. "Free" weights, on the other hand, include bar bells, dumb bells and a variety of other weights which are entirely supported by the weight lifter, and once lifted, are generally unrestricted in movement.

Although mechanical weights are generally considered safer to use because of the reduced likelihood that they will become uncontrollable when lifted, equivalent exercises performed with free weights generally result in better muscular development. Therefore, certain prior art devices, including the frame shown in the Callahan U.S. Pat. No. 3,118,668, and the safety stands positioned on either side of a bench shown in the McIntosh U.S. Pat. No. 4,205,838, provide support for a bar bell between exercises but only limited protection for the weight lifter. Another support structure for free weights is shown in the Harvey U.S. Pat. No. 2,470,815 which may be lifted in its entirety. However, that apparatus requires complex locking mechanisms at each end of the bar for attaching same to the uprights. Also, plates resting on the bases require radial slots for slipping over a respective upright. Therefore, this apparatus is not adaptable for use with existing bar bell sets because of the special clamps required for each end of the bar and the slotted plates required to weight the unit. Although conventional plates having apertures through the centers thereof might be attached to the bar bell ends as shown in phantom in the Harvey patent, their position would raise the center of gravity for the unit and increase the likelihood that it would topple over. Also, the plates resting at the bottoms of the uprights project inwardly therefrom and into the space occupied by the weight lifter, thereby either restricting the available space or requiring a longer bar than would otherwise be necessary.

The present invention seeks to overcome the above difficulties and comprises a novelly designed weight lifting safety frame having spaced standards with rods extending outwardly from the lower ends thereof for receiving and supporting conventional weighted plates thereby substantially lowering the center of gravity of the frame as compared to conventional lifting weights and adapted for receiving a conventional type bar.

SUMMARY OF THE INVENTION

Accordingly, the principal objects of the present invention are: to provide a weight lifting safety frame which promotes muscular development in the same manner as free weights; to provide such a frame with the relative safety of a mechanical weight lifting device; to provide such a frame which is self-supporting; to provide such a frame which supports a bar at a predetermined level; to provide such a frame which is adaptable for use with conventional weight lifting equipment; to provide such a frame with a pair of spaced standards and rods extending outwardly from lower ends thereof; to provide such a frame wherein the rods are adapted to receive plates having apertures through the centers thereof; to provide such a frame with a relatively low center of gravity; to provide such a frame wherein the plates may be quickly and easily added or removed; to provide such a frame wherein the plates are positioned outwardly of the standards and away from a weight lifter; to provide such a frame which is adapted for use with a conventional bar bell and attachment means therefor; to provide such a frame wherein each standard has a plurality of apertures each adapted for receiving an end of the bar; to provide such a frame wherein the standard apertures are also adapted for receiving inwardly extending hand pegs which may be grasped by a weight lifter to lift the frame; to provide such a frame which may easily be adjusted to accomodate different exercises; and to provide such a frame which is economical to manufacture, efficient in use, capable of a long operating life, and particularly well adapted for the proposed usage thereof.

Other objects and advantages of this invention will become apparent from the following description taken in conjunction with the accompanying drawings wherein are set forth, by way of illustration and example, certain embodiments of this invention.

A safety frame is provided which is self-supporting on a pair of bases and has spaced standards each extending upwardly from a respective base with a bar extending therebetween and attached to upper ends of the respective standards. Rods extend outwardly from each standard lower end and receive plates having apertures therethrough. The frame is liftable by a person positioned between the standards and grasping the bar.

The drawings constitute a part of the specification and include exemplary embodiments of the present invention and illustrate various objects and features thereof.

BRIEF DESCRIPTION OF THE DRAWINGS

FIG. 3 is a fragmentary, side elevational view of the safety frame in reduced scale including a lower bar extending between the standards.

FIG. 6 is an enlarged fragmentary perspective view of a second modified embodiment of the present invention, particularly showing a standard upper end with a plurality of interconnected apertures.

FIG. 7 is a side elevational view of the frame of FIG. 1 in reduced scale showing a weight lifter in a starting position for a bench press exercise.

FIG. 8 is a side elevational view of the frame of FIG. 1 in reduced scale shown elevated by a weight lifter doing a squat exercise.

DESCRIPTION OF THE PREFERRED EMBODIMENTS

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
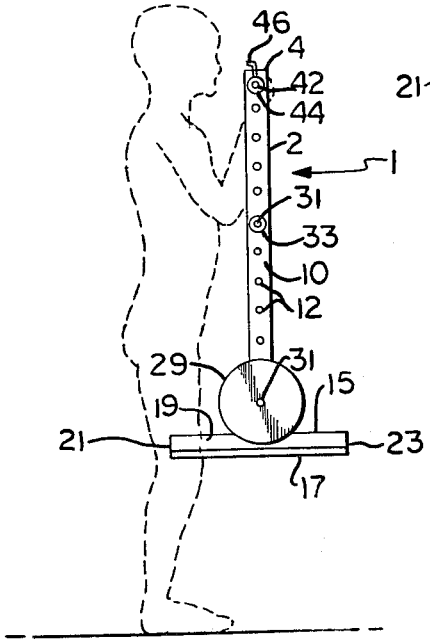
FIG. 2 is a side elevational view of the frame in reduced scale shown held in an elevated position by a weight lifter.

For purposes of description, the terms "upper", "lower", "right", "left", "vertical", "horizontal" and derivities thereof shall relate to the invention as seen from the left side of FIG. 2 looking right, that is, from the orientation of the weight lifter shown in phantom in FIG. 2. However, it is to be understood that the invention may assume various alternative orientations, except where expressly specified to the contrary.

Figure 1:
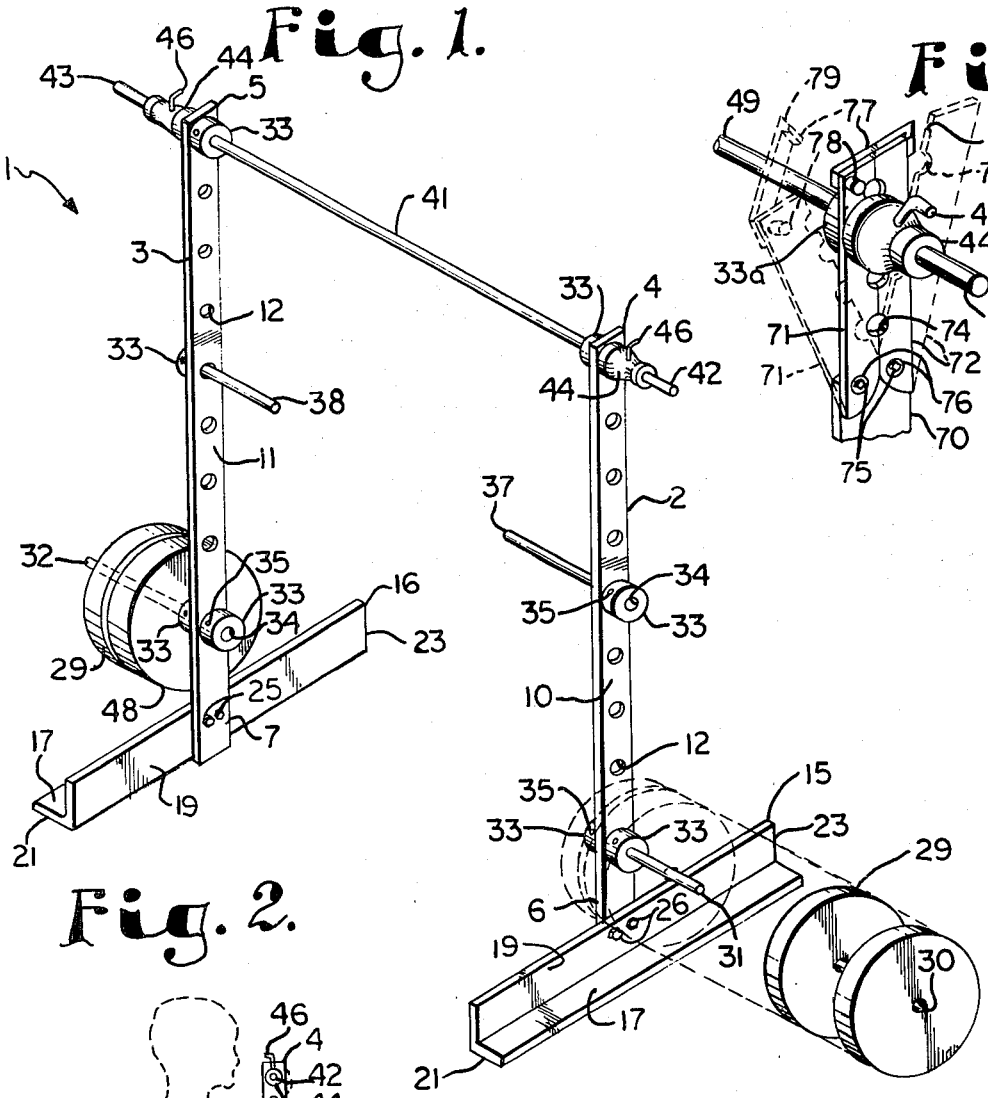
FIG. 1 is a perspective view of a weight lifting safety frame embodying the present invention.

The reference numeral 1 generally designates a weight lifting safety frame embodying the present invention. Right and left spaced standards 2 and 3 have respective upper ends 4 and 5 and respective lower ends 6 and 7. The standards 2 and 3, as shown in FIG. 1, each have a longitudinal configuration, a generally rectangular cross section and are comprised of a rigid material. The standards 2 and 3 have an outer face 10 and an inner face 11, both of the inner faces 11 being in facing relationship to each other. Each standard 2 and 3 has a plurality of vertically spaced apertures 12 extending between respective inner and outer faces thereof. As shown in FIG. 1, the apertures 12 are substantially evenly spaced and have approximately equal diameters. The apertures 12 allow for the frame 1 to be adjusted for performing a variety of exercises therewith, as will be more fully described herein.

The standards 2 and 3 each form the configuration of an inverted "T" with respective right and left bases 15 and 16. The right and left bases 15 and 16 respectively each comprise a horizontal flat portion 17 and a vertical wall portion 19 to form an angular cross-sectional configuration and are constructed from lengths of angle iron or a similar rigid material. The right and left bases 15 and 16 respectively are generally parallel and each has a respective first distal end 21 and a respective second distal end 23. The junctures between the right and left base wall portions 19 and respective right and left standard lower ends 6 and 7 are each rigidly secured by fastener means such as the bolts 25 and nuts 26 as shown in FIG. 1. Although the bolts 25 and the nuts 26 are shown, any suitable fastening means may be employed including welding or even casting the standards 2 and 3 as one piece with respective bases 15 and 16. With the right and left standards 2 and 3 rigidly connected to the bases 15 and 16 respectively, the frame 1 tends to resist toppling forward or backward and, even if set down at an angle somewhat askew from the vertical, the frame 1 tends to right itself, as further explained herein.

The weight lifting safety frame 1 of the present invention is intended to be used with a conventional bar bell set which generally includes a plurality of plates 29. Such plates 29 typically have an aperture 30 through the center thereof and a predetermined weight. The weight lifter may then vary the total weight of such a bar bell by utilizing a predetermined combination of the plates 29 to achieve a desired total weight. Because such required total weight may vary depending upon the individual weight lifter or exercise, it is desirable that means be provided for quickly and easily adding or removing the weights 29.

Positioning the plates 29 at the standard lower ends 6 and 7 and relatively near the bases 15 and 16 thus maintains the center of gravity associated with respective standards 2 and 3 substantially near respective bases 16 and 17 and relatively low. Also, the distance between the ends 21 and 23 of each base 15 and 16 is substantially greater than the distance between respective centers of gravity of the standards 2 and 3 and the attachments thereof to the bases 15 and 16 as shown in FIGS. 1 and 2. The weighted standards 2 and 3 therefore each exert a downward force due to gravity across a lever arm extending from either end 21 and 23 to the attachments thereof to respective bases 15 and 16. These downward forces tend to stabilize the standards 2 and 3 individually and the safety frame 1 as a whole in an upright position and resist lateral forces which might otherwise topple the safety frame 1. Such a lateral force acting against the center of gravity of either standard 2 or 3 acts across a substantially shorter lever arm defined by the distance between the center of gravity and the respective attachment between a standard 2 or 3 and respective base 15 or 16. Thus, a significant mechanical advantage is afforded the downward-acting stabilizing forces with respect to a lateral toppling force. Therefore, in the event the safety frame 1 is dropped or set down at a skewed angle, either of the ends 21 or 23 of a respective base 15 or 16 will probably engage the floor surface first, and, if the standard center of gravity is positioned directly over the base 15 or 16, the safety frame 1 will right itself.

The safety frame 1 of the present invention provides a novel means for attaching the plates 29 with the right and left plate rods 31 and 32 respectively positioned within apertures 12 through each of the respective right and left standard lower ends 6 and 7. The plate rods 31 and 32 are each secured in position by a pair of locking sleeves 33 positioned adjacent the respective inner and outer surfaces on either side of each respective standard 2 and 3. Each sleeve 33 has an aperture 34 therethrough for receiving a respective plate rod 31 or 32 and a set screw 35 for securely clamping respective plate rods 31 and 32 therein. Fastening means such as the sleeves 33 may be found in conventional bar bell sets. The right and left plate rods 31 and 32 respectively are thus securely attached to respective right and left standards 2 and 3 and cantilever outwardly therefrom. The apertures 30 of the plates 29 slidably receive the right and left plate rods 31 and 32 respectively and a predetermined combination of the plates 29 may, in this manner, be readily placed on the weight lifting safety frame 1 of the present invention.

With conventional bar bells, means is normally provided for preventing the plates from sliding off the ends of the bar, for example, by the use of additional sleeves 33 or collars such as those shown at 44. It will be appreciated that such additional sleeves 33 may be attached to the plate rods 31 and 32 of the present invention outwardly of respective plates 29 to retain the plates 29. However, the weight lifting safety frame 1 of the present invention is considerably more stable than conventional bar bells because of its lower center of gravity with the plates 29 supported relatively near respective right and left bases 15 and 16. Thus, the weight lifting safety frame 1 is less likely to swing far enough from an upright orientation to cause a plate 29 to be dropped and the friction engagement alone between the weight rods 31 and 32 and respective plates 29 is generally sufficient to retain the plates 29 in position. Also, because the plates 29 are positioned relatively closer to a ground or floor surface with the safety frame 1 than with conventional bar bells, the likelihood of damage if they are accidentally dropped is reduced as compared with such conventional equipment. Further, the positioning of the plates 29 as shown outwardly of each respective standard lower end 6 and 7 provides clearance for a weight lifter positioned between the standards 2 and 3.

For certain exercises, right and left hand pegs 37 and 38 respectively are utilized with the frame 1 and each extend inwardly through respective horizontally spaced apertures of the set of apertures 12 in each of the right and left standards 2 and 3 respectively. Each hand peg 37 and 38 also extends through the aperture 34 of a respective sleeve 33, as previously described, and is retained therein by an associated set screw 35. A weight lifter positioned between the standards 2 and 3 may grasp the hand pegs 37 and 38 to lift the safety frame 1, for example, to do a bench press exercise as shown in FIG. 7. Preferably, the hand pegs 37 and 38 are receivable in each of the standard apertures 12 for positioning at different levels to accomodate different weight lifters and for using the safety frame for a variety of different exercises. As shown in FIG. 1, the hand pegs 37 and 38 are each held in position by a single sleeve 33 positioned against the outer surface 10 of the right standard 2 and the left standard 3. Although additional collars may be provided adjacent the standard inner faces 11 for additional rigidity of the hand pegs 37 and 38, the safety frame 1 is easily liftable with the hand pegs 37 and 38 deflected slightly upwardly as will occur when each is secured by a single sleeve 33, as is shown in FIG. 1.

An upper bar 41 is substantially equivalent to the bars found in conventional bar bell sets and has opposed right and left ends 42 and 43 respectively each extending through horizontally spaced apertures 12 of the right and left standard upper ends 4 and 5 respectively. The mounting hardware which is normally included with conventional bar bell sets for mounting plates such as the plates 29 to ends of the bar 41 also generally includes collars 44 with apertures therethrough and L-shaped set screws 46. Such collars 44 in conjunction with the sleeves 33 are utilized in the present embodiment for securing the right and left upper bar ends 42 and 43 respectively to the right and left standard upper ends 4 and 5 respectively. The L-shaped set screws 46 allow the collars 44 to be readily attached to and removed from a respective upper bar end 42 and 43.

The upper bar 41 shown with the present embodiment has substantially the same diameter as the hand pegs 37 and 38 and is thereby adapted for being inserted through any horizontally aligned pair of the apertures 12 to position the upper bar 41 at various levels to accomodate different weight lifters and exercises.

An optional lower bar 51 for certain exercises is shown attached to the safety frame 1 in FIG. 3. The lower bar 51 has a right end 52 and a left end 53 each having a respective bore 54 extending inwardly therefrom. Alternatively, the lower bar 51 may comprise a hollow pipe with a length substantially corresponding to the spacing of the uprights 2 and 3. The lower bar 51 is secured in position by extending each of the right and left hand pegs 37 and 38 respectively through an aperture 12 on a standard 2 or 3 and into the bore 54 aligned therewith as shown in FIG. 3. The lower bar 51 may thus be easily mounted between any horizontally aligned pair of apertures 12 and grasped by a weight lifter in much the same manner as the upper bar 41. The lower bar 51 as shown attached with the hand pegs 37 and 38 is thereby even easier to reposition at a different level than the upper bar 41 which requires the loosening of the L-shaped set screws 46 to remove the collars 44 for removing the bar 41 and the reverse process for remounting. Also, additional rigidity is added to the safety frame 1 by the addition of the lower bar 51 with the upper bar 41 still in position, because the right and left standards 2 and 3 will thereby tend to be retained in a parallel configuration.

Figure 4:
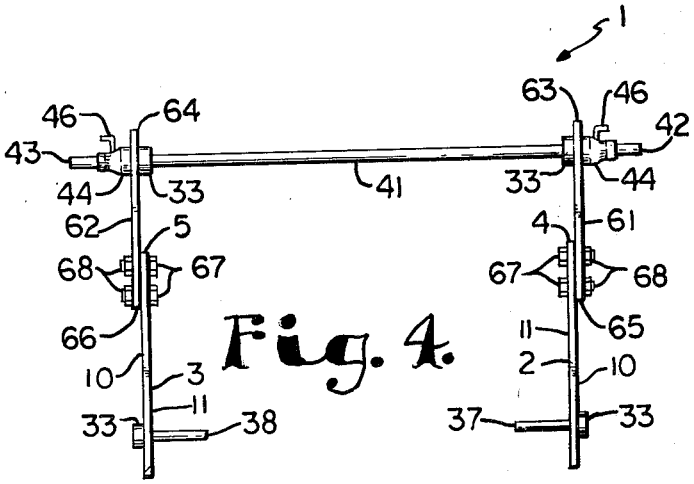
FIG. 4 is a fragmentary, side elevational view of the safety frame in reduced scale including a pair of extensions attached to upper ends of the standards.

Optionally, the level of the upper bar 41 may be raised even more with right and left extensions 61 and 62 respectively (FIG. 4). The extensions 61 and 62 have right and left upper ends 63 and 64 respectively and right and left lower ends 65 and 66 respectively and are attached to the right and left standard upper ends 4 and 5 respectively by bolts 67 and nuts 68 positioned in the standard apertures 12 and respective apertures (not shown) in extension lower ends 65 and 66 aligned therewith. The upper bar 41 is attached in a similar manner as hereinbefore described by placing the bar ends 42 and 43 thereof within apertures (not shown) in extension right and left upper ends 63 and 64 respectively and is retained with the sleeves 33 and the collars 44. With the upper bar 41 thus attached to the extensions 61 and 62, the weight lifter may exercise with it from a considerably higher starting position, eliminating the need to first raise the safety frame 1 to such a higher position before performing a desired exercise.

In use as a weight lifting device, the safety frame 1 of the present invention is readily adjustable to accomodate different weight lifters performing a variety of exercises and provides the inherent benefits associated with free weights with relative safety.

Bench press (FIG. 7) and squat (FIG. 8) exercises typically are dangerous to perform because both of those exercises generally require heavy weights with the athlete position directly under the bar, thus increasing the likelihood of the weights becoming uncontrollable and injuring the weight lifter. The present invention reduces the danger of doing such exercises since the frame 1 tends to support the weights 29 on the ground before such weights can fall on and injure the lifter. For bench press exercises, the right and left standards 2 and 3 respectively are positioned on either side of a bench 80, as shown in FIG. 7. A weight lifter in a supine position the bench 80 then raises and lowers the safety frame 1 by grasping either the upper bar 41, the hand pegs 37 and 38 or the lower bar 51. The safety frame 1 is positioned upright before each bench press is begun and if accidentally dropped, will land in an upright position with the upper bar 41, the hand pegs 37 and 38, or the lower bar 51 safely above the weight lifter.

For squat exercises, (FIG. 8), the weight lifter is positioned between the standards 2 and 3 with knees bent and with the bar 41 resting on his or her shoulders. The athlete then stands up to raise the safety frame 1 and then squats to the starting position. If the weightlifter should become unable to complete the exercise with the safety frame 1 raised, it may be safety dropped or quickly set down in the upright position thereof without endangering the lifter.

Other weight lifting exercises may be safely performed with the safety frame 1 of the present invention. Curls are done with the bar 41 extended through apertures 12 of appropriate vertical height and the weight lifter then grasping the upper bar 41 with his palms facing up and raising it to his on her chest. Rowing exercises involve grasping the upper bar 41 with palms facing downward and arms extended and pulling the safety frame 1 upward with a rowing motion. The upper bar 41 may be positioned in the uppermost apertures 12 or a lower aligned pair of apertures 12 depending upon whether the athlete prefers a standing or bent over starting position for such rowing exercises.

For miltary press and toe raise exercises, the extensions 61 and 62 may be optionally utilized for positioning the upper bar 41 at a shoulder high starting position. For developing the lattisimus dorci lat muscle, the athlete may raise and lower the safety frame 1 with a handle having a line attached thereto which line extends over a pulley (this structure not shown). The upper bar 41 provides a convenient place for attaching the line and the low center of gravity of the safety frame 1 assures that it will remain in an upright position as it is raised and lowered.

For achieving overall muscular development, it is generally considered desirable for a weight lifting session to include a number of different exercises directed to specific muscle groups. The safety frame 1 of the present invention is accordingly adjustable with minimal effort to a number of configurations with the bars 41 and 51 or the hand pegs 37 and 38 or both positioned at different levels. The weight rods 31 and 32 provide a convenient means for achieving a desired weight combination without having to remove the sleeves 33 or the collars 44, as is required with most conventional bar bell sets to add to remove the plates 29. This is because the friction engagement with the rods 31 and 32 is generally sufficient to hold the plates 29 in position thereon. Also, the low center of gravity of the safety frame 1 along with the bases 19 engaging the floor in a generally horizontally spaced and parallel configuration tend to stabilize same in an upright position.

Regardless of any direct exercise performed, the safety frame 1 functions as a free weight for maximum benefit to the weight lifter because, once lifted, its movement is substantially unrestricted. Also, the present invention is considerably safer than conventional bar bell type free weights because if an athlete, having lifted the frame 1, becomes unable to complete the exercise, the safety frame 1 will drop to its original free-standing starting position with the bar 41 positioned at a predetermined level. Conventional bar bells, on the other hand, can either trap a weight lifter thereunder, or if dropped, fall from a considerable height with resultant damage to the bar bell, a floor surface or both. A further advantage of utilizing the safety frame 1 is that a convenient starting and stopping position is thereby provided for each exercise. Thus, the athlete need not support the weights between exercises, while recouping his or her strength. The safety frame 1 also facilitates exercising without assistants or "spotters" for holding the weights for the weight lifter in a starting position and catching them if the exercise goes awry. Thus weight lifters who find it more convenient to exercise alone are able to lift heavier weights with less risk than is possible with conventional bar bell sets.

Figure 5:
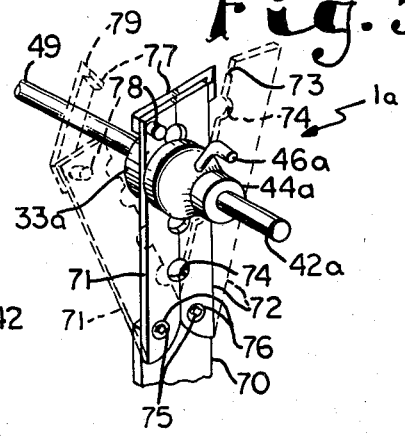
FIG. 5 is an enlarged fragmentary perspective view of a first modified embodiment of the present invention, particularly showing a standard upper end comprising a pair of pivotal sections for clamping a bar.

The reference numeral **1*a* (FIG. 5) generally represents a first modified embodiment of the invention having a modified right standard 70 and a left standard (not shown). Since the safety frame 1*a* is otherwise substantially the same as the previously described safety frame 1, similar parts appearing in FIG. 5 and FIGS. 1–4 respectively are represented by the same, corresponding reference numeral except for the addition of the suffix "a" to the numerals of the modified device. The right standard 70 includes a first and a second section 71 and 72 respectively, each rotatably secured to the right standard 70 by a bolt 75, a washer 76 and a nut (not shown). The first and second sections 71 and 72 respectively are rotatable from an open position, as shown in phantom in FIG. 5, to a closed position where they are secured together by a latch 77 pivotally connected to the first section 71 by a rivet 78 and having a hook-shaped end portion 79 for engaging and locking with the second section 72. With the sections 71 and 72 in their closed and latched positions, a sleeve 33*a* and a collar 44*a* with an L-shaped screw 46*a* retain an upper bar end 42*a* rigidly connected to the right standard 70. The mounting position of the bar end 42*a* may be adjusted by releasing the latch 77, repositioning the right end 42*a* thereof between an opposed pair of half-apertures 74 corresponding to the desired level of the bar 41*a*, pivoting the first and second sections 71 and 72 respectively until their edges 73 engage and rotating the latch 77 to a closed position thereof with the hook-shaped end portion 79 engaging the second section 72. The left end (not shown) of the bar 41*a* is similarly repositioned within a corresponding pair of half-apertures. Utilizing this repositioning procedure, it is therefore unnecessary to release the L-shaped set screws 46*a*, remove the collars 44*a*, reposition the upper bar 41*a* and reattach the collars 44*a* each time a different position of the upper bar 41*a*** is desired.

The reference numeral **1*b* (FIG. 6) generally represents a second modified embodiment of the safety frame having a modified right standard 82. Since the safety frame 1*b* is otherwise substantially the same as the previously described safety frame 1, similar parts appearing in FIG. 6 and FIGS. 1–4 respectively are represented by the same, corresponding reference numeral except for the addition of the suffix "b" to the numerals of the modified device. A plurality of interconnected apertures 83 extend through the right standard 82 in an alternating and staggered configuration as shown. The apertures 83 are connected by a connecting slot 84 having a width slightly larger than the diameter of an upper bar 41*b*. The right bar end 42*b* is thereby slidable within the connecting groove 84 to any of the apertures 83 for supporting the upper bar 41*b* at a predetermined level with a sleeve 33*b* and a collar 44*b* attached thereto. The left standard (not shown) of this embodiment 1*b* has similar corresponding interconnected apertures, as described for the right standard 82, for receiving the left end (not shown) of the bar 41*b*. The bar 41*b* may thus be easily and quickly repositioned at different levels without removing the sleeves 33*b* or the collars 44*b* from the ends thereof. The respective right bar end 42*b* and left bar end (not shown) are partially encircled and held by respective apertures 83 whereby the safety frame 1*b* is supported by the bar 41*b*** when lifted.

Although the safety frames illustrated herein utilize bars, plates, sleeves and collars commonly found with conventional bar bell sets, a variety of different weight lifting equipment is compatible therewith. For example, specialized weight lifting bars particularly used for performing curls and having curved portions may be attached to the standards 2 and 3 in the same manner as the conventional upper bar 41 shown. Also, a frame such as that shown in U.S. Pat. No. 4,018,442, which surrounds a weight lifter, is compatible with the present invention. Bars having opposed end portions with greater diameters than an intermediate portion therebetween are also adaptable for use with the weight lifting safety frame 1 embodying the present invention by enlarging the diameter of the apertures 12 in the standard upper ends 4 and 5. The plates used with such bar bell sets also have correspondingly larger apertures therethrough, but are supportable by weight rods 31 and 32 in the same manner as the conventional plates 29.

The safety frame of the present invention may be fabricated of virtually any material having sufficient strength and rigidity, for example, metal, wood, plastic, fiberglass, stiff rubber or any combination thereof.

If is to be understood that while certain forms of the present invention have been illustrated and described herein, it is not to be limited to the specific forms or arrangements of parts described and shown.

What is claimed and desired to secure by Letters Patent is:

1. A weight lifting safety frame comprising:

(a) a pair of upright horizontally spaced standards; each of said standards having an upper and a lower end and inner and outer surfaces, said inner surfaces being in opposed facing relationship;

(b) a pair of horizontally spaced bases for engaging a support surface; each of said bases attached to a respective standard lower end;

(c) a pair of rods positioned near the lower ends of the standards; each of said rods extending outwardly from a respective standard outer surface;

(d) a plurality of weighted plates; each said plate having an aperture therethrough for slidably receiving and being supported by only a respective rod; and (e) said standard upper ends being interconnected by a generally horizontally aligned upper bar; said upper bar having a pair of opposed ends, each said end being attached to a respective standard upper end; said frame being liftable by a person grasping said upper bar intermediate said standard upper ends.

2. A safety frame as set forth in claim 1 wherein:

(a) each said base has a longitudinal configuration with opposed first and second ends; and (b) each said base is attached to a respective standard intermediate said ends and substantially perpendicular to said respective standard.

3. A safety frame as set forth in claim 2 wherein:

(a) said bases are generally parallel; and (b) the distance between the juncture of a standard and respective base and either distal end of the respective base is substantially greater than the distance between said juncture and the location of the respective rod associated with the standard.

4. A safety frame as set forth in claim 2 which includes:

(a) each of said bases including:

(1) a flat portion for engaging a substantially horizontal surface; and (2) a wall portion extending upwardly from said flat portion; and (b) attachment means for attaching each said base wall portion to a respective standard lower end.

5. A safety frame as set forth in claim 1 which includes:

(a) a pair of upper rods; each of said rods attached to a respective standard at a position intermediate said upper end and said lower end thereof and extending inwardly from said inner surface of said respective standard;

(b) whereby said exercising apparatus is liftable by a person grasping said upper rods.

6. A safety frame as set forth in claim 5 which includes:

(a) a lower bar having opposed ends;

(b) a bore extending into each respective said lower bar end; and (c) each of said bores being adapted for receiving a respective rod whereby each said lower bar end is connected to a respective standard and said lower bar extends between said inner surfaces of respective standards;

(d) whereby said safety frame is liftable by a person grasping said lower bar.

7. A safety frame as set forth in claim 1 wherein:

(a) each of said standard upper and lower ends has an aperture respectively therethrough; and (b) each of said upper bar ends extends through a respective standard upper end aperture; and (c) each of said lower rods extends through a respective standard lower end aperture.

8. A safety frame as set forth in claim 1 wherein:

(a) each of said standards has an aperture intermediate said standard upper and lower ends; and (b) each of said apertures receives a respective upper bar end therethrough.

9. A safety frame as set forth in claim 1 wherein:

(a) each of said standards includes apertures intermediate said standard upper and lower ends for receiving a respective upper rod therein.

10. A safety frame as set forth in claim 1 which includes:

(a) a pair of extensions; each extension being attached to a respective standard upper end; and wherein (b) each of said upper bar ends is attached to a respective extension; said upper bar thereafter being positioned in spaced relation to said standard upper ends.

11. A safety frame as set forth in claim 1 wherein:

(a) each of said standard upper ends has a plurality of apertures associated therewith;

(b) each of said apertures being adapted for receiving a respective end of said upper bar therethrough;

(c) each of said standard upper ends including a slot interconnecting said apertures associated therewith;

and (d) each of said upper bar ends being adapted for sliding within a respective slot from a first of said apertures to a second of said apertures.

12. A safety frame as set forth in claim 1 which includes:

(a) a pair of sections being pivotally attached to each of said standard upper ends; and (b) each pair of said sections being rotatable from an open position for receiving a respective end of said bar to a closed position for securing a respective end of said upper bar; and (c) latch means for securing each respective pair of sections in said closed position.

13. A weight lifting safety frame comprising:

(a) a pair of spaced standards each having an inner surface and an outer surface and an upper end with an aperture therethrough and a lower end with an aperture therethrough;

(b) said inner surfaces being in facing relationship;

(c) a pair of longitudinal bases each having a first and a second end and attached intermediate said first and second ends to a respective standard lower end;

(d) a pair of lower rods each extending through a respective standard lower end aperture and extending from the respective standard outer surface;

(e) a pair of weighted plates each having an aperture therethrough for slidably receiving a respective lower rod;

(f) a pair of upper rods each extending through an aperture positioned intermediate said upper and lower ends of a respective standard, each said rod extending from the inner surface of a respective standard; said frame being liftable by a person grasping said upper rods; and (g) said standard upper ends being adapted for being interconnected by a generally horizontally aligned upper bar having a pair of opposed ends each extending through a respective said standard upper end aperture, said frame being liftable by a person grasping said upper bar.

14. A frame as set forth in claim 13 wherein:

(a) each said lower rod extends through and supports a plurality of said plates in juxtaposed position.

15. A frame as set forth in claim 13 which includes:

(a) a pair of extensions each attached to a respective upper end of a respective said standard; and (a) each of said ends of said bar being attached to a respective extension.

16. A safety frame for supporting a plurality of weighted plates each having an aperture therethrough, which comprises:

(a) a pair of upright horizontally spaced standards each having an upper and a lower end and a surface;

(b) a pair of horizontally spaced bases for engaging a support surface, each of said bases being attached to a respective standard lower end;

(c) a pair of rods each extending outwardly from a respective standard surface in close-spaced relation above said standard lower most end, said rods each being slidably receivable in a respective weighted plate aperture whereby a weighted plate is mounted on said safety frame by only said rods; and (d) a generally horizontally aligned upper bar interconnecting said standard upper ends, said upper bar having a pair of opposed ends each attached to a respective standard upper end;

(e) said frame being liftable by a person grasping said upper bar intermediate said standard upper ends.

17. A safety frame as set forth in claim 16 which includes:

(a) each of said spaced standards having an inner surface and an outer surface;

(b) said inner surfaces being in facing relationship; and (c) each of said rods extending outwardly from a respective said standard outer surface.

18. A safety frame as set forth in claim 16 which includes:

(a) each said standard having a plurality of spaced apertures, each of said apertures being adapted for receiving said upper bar therethrough.

* * * * *